US005676311A

United States Patent [19]

Hartman

[11] Patent Number: 5,676,311

[45] Date of Patent: Oct. 14, 1997

[54] ACTUATOR FOR SPRAY VALVE

[75] Inventor: Eric Eugene Hartman, Ridgefield, Conn.

[73] Assignee: Chesebrough-Pond's USA Co., Division of Conopco, Inc., Greenwich, Conn.

[21] Appl. No.: 512,616

[22] Filed: Aug. 8, 1995

[51] Int. Cl.[6] ..... B05B 1/28

[52] U.S. Cl. ..... 239/120; 239/337; 239/492; 222/108

[58] Field of Search ..... 239/120, 121, 239/337, 373, 463, 490, 492, 497; 222/108, 402.1

[56] References Cited

U.S. PATENT DOCUMENTS

| | | | |
|---|---|---|---|
| D. 356,249 | 3/1995 | Abfier et al. . | |
| 3,033,473 | 5/1962 | Kitabayashi . | |
| 3,079,048 | 2/1963 | Wolfson et al. | 222/108 |
| 3,149,761 | 9/1964 | Harris et al. . | |
| 3,711,031 | 1/1973 | Ewald . | |
| 3,785,571 | 1/1974 | Hoening | 239/337 X |
| 3,838,822 | 10/1974 | Ewald . | |
| 5,314,123 | 5/1994 | Miller | 239/120 X |
| 5,395,050 | 3/1995 | Nowak et al. | 239/121 |

FOREIGN PATENT DOCUMENTS

| | | | |
|---|---|---|---|
| 1196036 | 12/1985 | U.S.S.R. | 239/492 |

*Primary Examiner*—Andrea Kashnikow
*Assistant Examiner*—Steven J. Ganey
*Attorney, Agent, or Firm*—Milton L. Honig

[57] ABSTRACT

An actuator for a spray valve is provided which includes an actuator head and spray producing body positioned within the head. The actuator head includes a mechanism for connecting the head to a spray valve and transfer channel for receiving a pressurized fluid from the spray valve. The transfer channel is formed with a terminal area surrounding an outlet orifice of the channel. The spray producing body is positioned against the terminal area and has a front wall distant therefrom. The spray producing body features a swirl chamber situated adjacent the outlet orifice, a first channel downstream from the swirl chamber, a second channel of narrower diameter and downstream from the first channel, an expansion orifice situated further downstream and at least four unconnected dead-ended recesses formed into the front wall and surrounding the expansion orifice.

5 Claims, 2 Drawing Sheets

ACTUATOR FOR SPRAY VALVE

BACKGROUND OF THE INVENTION

1. Field of the Invention

The invention relates to an actuator for operating a spray valve, especially for dispensing hairsprays, configured to minimize clogging of actuator channels caused by accumulated hairspray resin.

2. The Related Art

Actuators for aerosol dispensing valves operate to break up dispensed liquid into a fine mist. Too often actuators, especially in hairspray products, have the annoying propensity to malfunction. Polymeric resins forming the hairspray tend to deposit around the actuator clogging critical delivery passages. Ordinarily an aerosol dispenser functions well during early use. After some time, small quantities of resin remain with the actuator. Volatile solvent evaporates and thereby leaves a thick solid residue over discharge channels and orifices.

Self-cleaning spray buttons for aerosol valves are described in U.S. Pat. No. 3,838,822 and U.S. Pat. No. 3,711,031, both to Ewald. Starch derived clogs are eliminated by having the discharge outlet passageway taper outwardly to restrict the diameter of the spray pattern.

U.S. Pat. No. 3,149,761 (Harris et al.) reports a valve actuating assembly for pressurized containers, especially for delivering a herbicide. Accidental actuation is prevented through a locking mechanism surrounding the nozzle.

U.S. Pat. No. 3,033,473 (Kitabayashi) discloses an aerosol dispenser fitted with a spray nozzle for delivering agglutinative material such as sizings, paints and the like. Clogging of the nozzle is avoided through stirring action achieved by repeated up-and-down movement of an eductor tube communicating with an interior of the nozzle and a bottom of the product containing reservoir.

Despite these advances, a commercially successful anti-clogging actuator, especially for hairsprays, has eluded the art.

Accordingly, it is an object of the present invention to provide an actuator for a spray valve which avoids or at least minimizes clogging of dispensing passageways.

Another object of the present invention is to provide an actuator for a spray valve which is particularly suitable for delivery of hairspray products.

Still another object of the present invention is to provide an actuator for a spray valve which can be economically fabricated.

Yet another object of the present invention is to provide an aerosol spray valve which can be employed with standard aerosol containers.

SUMMARY OF THE INVENTION

An actuator for a spray valve is provided including:

an actuator head including:

(i) a mechanism for connecting the actuator head to a spray valve; and (ii) a transfer channel for receiving a pressurized fluid from the spray valve, the transfer channel having an inlet and an outlet orifice at opposite ends and a terminal area surrounding the outlet orifice;

a spray producing body positioned against the terminal area having a front wall distant from the terminal area and serving as an outermost surface, the spray producing body including:

(i) a swirl chamber adjacent the outlet orifice, communicating therewith and having cylindrical walls;

(ii) a first channel having cylindrical walls downstream from the swirl chamber, the cylindrical walls of the first channel being of narrower diameter than the cylindrical walls of the swirl chamber;

(iii) a second channel having cylindrical walls directed along a longitudinal axis, the cylindrical walls of the second channel being of narrower diameter than the cylindrical walls of the first channel;

(iv) an expansion orifice with first and second ends downstream from the second channel for releasing the pressurized fluid as a spray, the first end of the expansion orifice being further upstream than the second end and terminating in a land with an exterior surface perpendicular to the longitudinal axis, the land extending radially outward to an outer circumference; and (v) at least four unconnected dead-ended recesses being formed in an exterior surface of the front wall and surrounding the expansion orifice.

Additionally, an outwardly tapering cylindrical wall may rise from the outer circumference of the land and terminate in a mouth. A horizontal plane defines the mouth. In one embodiment, the horizontal plane of the mouth may coincide with another plane defining mouths of the at least four unconnected recesses. Alternatively, the horizontal plane of the mouth may be parallel to but not coinciding with a plane defining the at least four unconnected recesses.

A plurality of further unconnected dead-ended recesses may be formed in the exterior surface of the front wall. These are located radially outward from the first at least four unconnected dead-ended recesses. More specifically the two sets of deadended recesses will be configured as two respective concentric circles surrounding the expansion orifice.

Clogging of an actuator spray nozzle originates upon shutoff of the spray valve. A small amount of product remains over the expansion orifice. Surface tension spreads the unsprayed bubble remnant along the exterior surface of the front wall. The greater the spread of the bubble, the greater the clogging problem. Use of the dead-ended recesses restricts bubble expansion thereby avoiding a larger plug. Additionally, the outwardly tapering cylindrical wall rising from the outer circumference of the land of the expansion orifice is another feature limiting bubble expansion.

BRIEF DESCRIPTION OF THE DRAWINGS

The above features, advantages and objectives of the present invention will more fully be appreciated through the following detailed discussion, reference being made to the drawing consisting of.

DETAILED DESCRIPTION OF THE INVENTION

Figure 1:
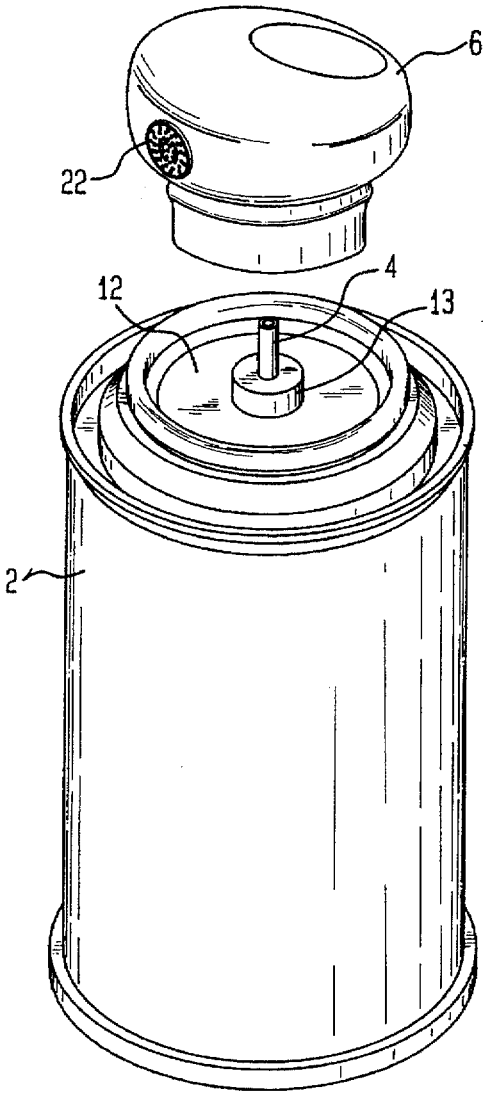
FIG. 1 which is a plan perspective view in exploded form of a pressurized can, valve and an actuator according to the present invention.
Figure 2:
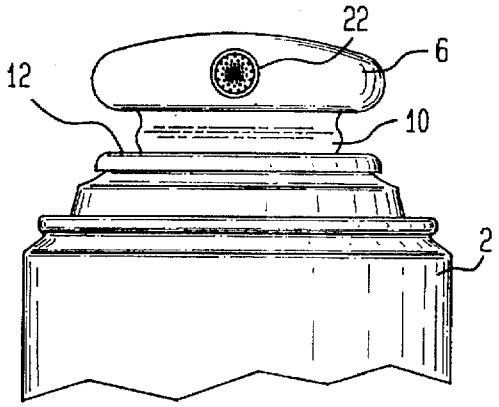
FIG. 2 which is a front view of the pressurized can and actuator of FIG. 1, the can being only partially shown.
Figure 5:
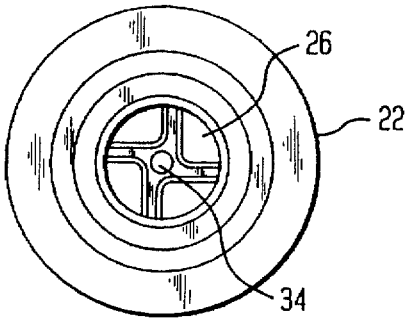
FIG. 5 which is a rear plan view of the spray producing body shown in FIG. 4.
Figure 3:
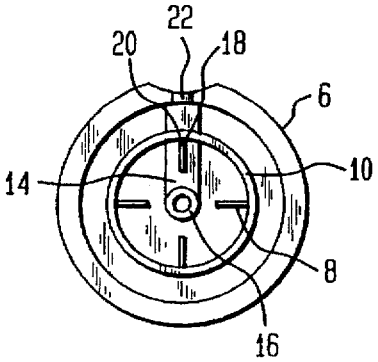
FIG. 3 which is a bottom plan view of the actuator shown in FIG. 1

Illustrated in FIG. 1 is a pressurized container 2 suitable for delivering a hairspray resin or similar product through assistance of a propellant or compressed air. On an exit end of container 2 is mounted a spray valve 4 which controls dispensing of product stored within the container. An actuator head 6 in the form of a button is mounted onto the spray valve 4. As best shown in FIG. 3, the underside of the actuator head 6 includes a set of four ribs 8 projecting inward from a skirt 10. Spray valve 4 is snugly connected to the actuator head by the form-fitting embrace of ribs 8. Actuator head 6 attaches to container 2 through a snap fit over a receiving barrel 13 of a neck 12 of the container. A pressurized fluid product from the container is delivered through the spray valve into a transfer channel 14 of the actuator head. Inlet and outlet orifices 16, 18 are formed at opposite ends of the transfer channel. Surrounding the outlet orifice 18 is a terminal area 20.

A spray producing body 22 is positioned against the terminal area and has a front wall 24 distant from the terminal area which serves as an outermost surface of the body.

Spray producing body 22 includes a swirl chamber 26 adjacent outlet orifice 18 communicating therewith and having cylindrical walls 28. Downstream from the swirl chamber is a first channel 30 having cylindrical walls 32. The cylindrical walls 32 of the first channel are of narrower diameter than the cylindrical walls 28 of the swirl chamber. A second channel 34 directed along a longitudinal axis L also has cylindrical walls 36. These walls of the second channel are of narrower diameter than the cylindrical walls 32 of the first channel.

Downstream from the second channel 34 is an expansion orifice 38 with first and second ends, the orifice functioning for releasing the pressurized fluid as a spray. The first end of the expansion orifice 38 is further upstream than the second end and features a land 40 with an exterior surface perpendicular to the longitudinal axis L. Land 40 extends radially outward.

At least four unconnected dead-ended recesses 42 are formed into an exterior surface of front wall 24. These dead-ended recesses 42 surround the expansion orifice 38.

Figure 6:
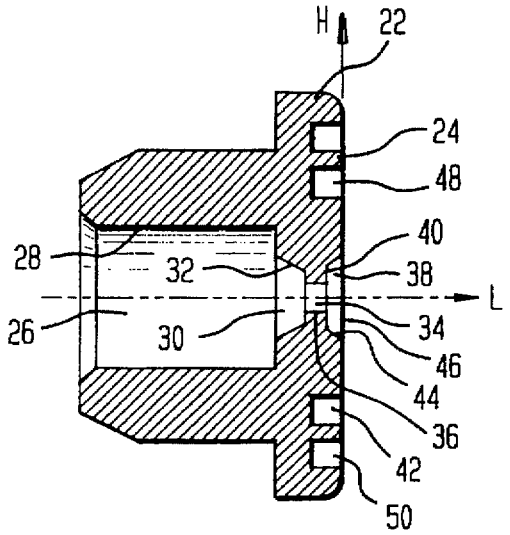
FIG. 6 which is a cross-section view taken along line 6—6 shown in FIG. 4.

FIG. 6 which is the preferred embodiment includes an outwardly tapering cylindrical wall 44 rising from the outer circumference of the land 40. Outwardly tapering cylindrical wall 44 terminates in a mouth 46 which is defined by a horizontal plane H. For this preferred embodiment, the horizontal plane H of mouth 46 coincides with a plane defining mouths 48 of the at least four unconnected recesses 42.

Figure 7:
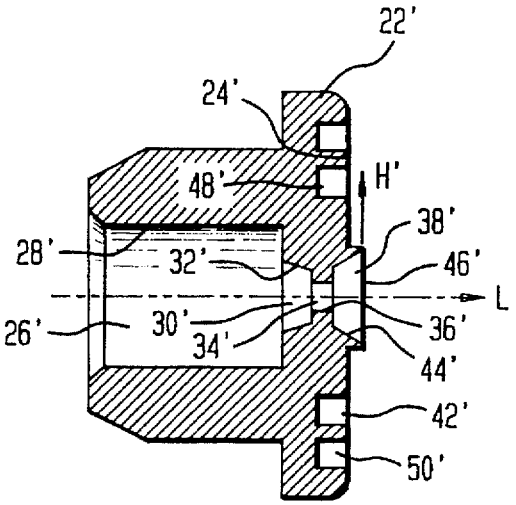
FIG. 7 which is a cross-section view similar to that of FIG. 6 but showing a second embodiment thereof.
Figure 8:
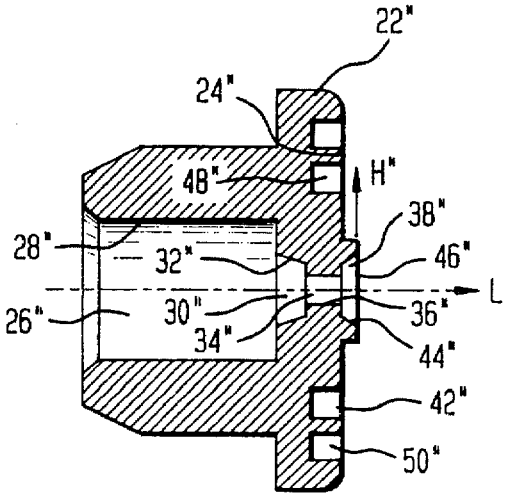
FIG. 8 which is a cross-section similar to FIG. 6 but showing a third embodiment thereof.

In the alternative embodiments shown in FIG. 7 and 8, the horizontal plane H' and H" of the mouth 46' and 46", respectively, of the expansion chamber do not coincide with a horizontal plane defining the at least four unconnected recesses 42' and 42". For purposes of FIG. 7 and 8, the same numbering scheme as in FIG. 6 has been adopted.

Figure 4:
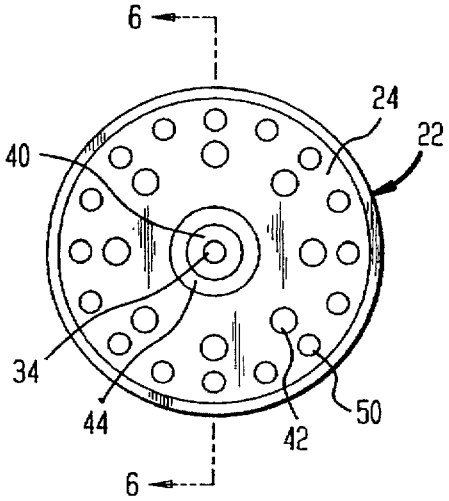
FIG. 4 which is a front plan view of a spray producing body positioned within a terminal area of the actuator head shown in FIG. 1.

FIG. 4 best illustrates the further feature of a plurality of further unconnected dead-ended recesses 50. These recesses 50 are formed in the exterior surface of the front wall 24 and located radially outward from the at least four unconnected dead-ended recesses 42.

EXAMPLES

Reported under this Example are the results from an Actuator Spray Test to determine cloggage on different actuator designs. Each of the test actuator designs were evaluated for =b 30days on a dozen hairspray cans. Half of the hairspray cans were actuated daily while the other half were sprayed on Monday, Wednesday and Friday; the latter sequence sought to replicate consumer usage and to accentuate the solvent evaporation effects. Also, for each design both acetal and polypropylene were evaluated as the plastic construction material. Results are recorded in the Table below.

TABLE I

CLOGGAGE STUDY

| SPRAY BODY TYPE | CLEAR[5] | STREAM/ CLEAR[6] | CLOG/ CLEAR[7] | CLOG[8] |
|---|---|---|---|---|
| Standard Insert[1] - Acetal | | | | |
| Daily | 76.50 | 17.40 | 3.80 | 2.30 |
| M,W,F | 98.00 | 2.00 | 0.00 | 0.00 |
| Design I[2] - Acetal | | | | |
| Daily | 85.00 | 14.00 | 1.00 | 0.00 |
| M,W,F | 94.43 | 2.60 | 0.97 | 2.00 |
| Design IV[3] - Acetal | | | | |
| Daily | 84.00 | 14.40 | 1.60 | 0.00 |
| M,W,F | 91.00 | 8.30 | 0.70 | 0.00 |
| Design IV[3] - Polypropylene | | | | |
| Daily | 82.00 | 17.40 | 0.60 | 0.00 |
| M,W,F | 96.20 | 3.80 | 0.00 | 0.00 |
| Design V[4] - Acetal | | | | |
| Daily | 83.00 | 16.60 | 0.40 | 0.00 |
| M,W,F | 92.40 | 7.60 | 0.00 | 0.00 |
| Design V[4] - Polypropylene | | | | |
| Daily | 89.90 | 10.10 | 0.00 | 0.00 |
| M,W,F | 97.00 | 3.00 | 0.00 | 0.00 |

[1]Same as Design I but without dead-ended recesses.
[2]Embodiment of FIG. 8.
[3]Embodiment of FIG. 7.
[4]Embodiment of Fig. 6.
[5]Clear = no obstruction of nozzle.
[6]Stream/Clear = spray begins eratic, product does dispense initially and then clears into a normal spray mode (clog dislodges).
[7]Clog/Clear = no spray emitted on first few button actuating attempts; after several further attempts the clog clears and spray emits.
[8]Clog = nothing dispenses even after repeated actuation of the button From the Table it is evident that the Design I spray body is less clogging than the Standard Insert. The difference in configuration and performance is considered due to the presence of the unconnected dead-ended recesses. Design V performed better than Design IV. Polypropylene was more effective than acetal as a construction material in preventing clogging.

The foregoing description and Examples illustrate selected embodiments of the present invention and in light thereof variations and modifications will be suggested to one skilled in the art, all of which are within the spirit and purview of this invention.

What is claimed is:

1. An actuator for a spray valve on a hairspray resin delivering dispenser comprising:

an actuator head comprising:

(i) a means for connecting the actuator head to a spray valve; and (ii) a transfer channel for receiving a pressurized fluid from the spray valve, the transfer channel having an inlet and an outlet orifice at opposite ends and a terminal area surrounding the outlet orifice;

a spray producing body positioned against the terminal area having a front wall distant from the terminal area and serving as an outermost surface, the spray producing body comprising:

(i) a swirl chamber adjacent the outlet orifice, communicating therewith and having cylindrical walls;

(ii) a first channel having cylindrical walls downstream from the swirl chamber, the cylindrical walls of the first channel being of narrower diameter than the cylindrical walls of the swirl chamber;

(iii) a second channel having cylindrical walls directed along a longitudinal axis, the cylindrical walls of the second channel being of narrower diameter than the cylindrical walls of the first channel;

(iv) an expansion orifice with first and second ends downstream from the second channel for releasing the pressurized fluid as a spray, the first end of the expansion orifice being further upstream than the second end and featuring a land with an exterior surface perpendicular to the longitudinal axis, the land extending radially outward to an outer circumference; and (v) at least four unconnected dead-ended recesses being formed in an exterior surface of the front wall and surrounding the expansion orifice.

2. The actuator according to claim 1 further comprising an outwardly tapering cylindrical wall rising from the outer circumference of the land and terminating in a mouth, a horizontal plane being defined by the mouth.

3. The actuator according to claim 2 wherein the horizontal plane of the mouth coincides with a plane defining mouths of the at least four unconnected dead-ended recesses.

4. The actuator according to claim 2 wherein the horizontal plane of the mouth is parallel to but does not coincide with a plane defining mouths of the at least four unconnected dead-ended recesses.

5. The actuator according to claim 1 further comprising a plurality of further unconnected dead-ended recesses being formed in the exterior surface of the front wall and being located radially outward from the at least four unconnected dead-ended recesses.

* * * * *